US009007281B2

(12) United States Patent
Yoon et al.

(10) Patent No.: US 9,007,281 B2
(45) Date of Patent: Apr. 14, 2015

(54) ORGANIC LIGHT EMITTING DIODE DISPLAY DEVICE CAPABLE OF COMPENSATING A THRESHOLD VOLTAGE OF A DRIVING TFT

(71) Applicant: LG Display Co., Ltd., Seoul (KR)

(72) Inventors: Joongsun Yoon, Gyeonggi-do (KR); Jihyun Kang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 126 days.

(21) Appl. No.: 13/666,061

(22) Filed: Nov. 1, 2012

(65) Prior Publication Data

US 2013/0113779 A1 May 9, 2013

(30) Foreign Application Priority Data

Nov. 8, 2011 (KR) ..... 10-2011-0115577

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01); *G09G 2320/0223* (2013.01); *G09G 2320/043* (2013.01)

(58) Field of Classification Search
CPC ..... G09G 3/12; G09G 3/30–3/3291; G09G 2300/04–2300/0895; G09G 2310/00–2310/0221; G09G 2310/0264–2310/062
USPC ..... 345/36, 45, 76–86
See application file for complete search history.

(56) References Cited

U.S. PATENT DOCUMENTS

2003/0227262 A1* 12/2003 Kwon ..... 315/169.3
2004/0145547 A1* 7/2004 Oh ..... 345/76
2004/0196239 A1* 10/2004 Kwon ..... 345/92
2005/0052377 A1* 3/2005 Hsueh ..... 345/82
2005/0093464 A1* 5/2005 Shin et al. ..... 315/169.1

(Continued)

FOREIGN PATENT DOCUMENTS

CN 1835058 A 9/2006
CN 101086817 A 12/2007
JP 2006-023515 1/2006

OTHER PUBLICATIONS

European Search Report dated Jan. 3, 2013 for corresponding EP Patent application No. 12187449.9.

(Continued)

*Primary Examiner* — Sanghyuk Park
(74) *Attorney, Agent, or Firm* — Morgan, Lewis & Bockius LLP

(57) ABSTRACT

This embodiments herein relate to an organic light emitting diode display device comprising: a display panel configured to include a plurality of pixels disposed in a matrix form, wherein each of the pixels including: a driving TFT, an organic light emitting diode, a control circuit including first to fourth TFTs, capacitors. The embodiments described herein may improve accuracy of sensing a threshold voltage of the driving TFT even though the organic light emitting diode display device drives high frequency such as 240 Hz because sensing periods are long enough to sense the threshold voltage of the driving TFT. Also, the embodiments described herein may compensate a drop of a high potential voltage due to compensating the current between a drain electrode and a source electrode of the driving TFT by using the high potential voltage dropped.

10 Claims, 5 Drawing Sheets

(56) References Cited

U.S. PATENT DOCUMENTS

| | | | | |
|---|---|---|---|---|
| 2006/0044235 | A1* | 3/2006 | Lee et al. | 345/82 |
| 2006/0066531 | A1* | 3/2006 | Park et al. | 345/76 |
| 2006/0139259 | A1* | 6/2006 | Choi et al. | 345/76 |
| 2006/0221662 | A1* | 10/2006 | Park et al. | 365/145 |
| 2007/0046593 | A1* | 3/2007 | Shin | 345/81 |
| 2008/0001861 | A1 | 1/2008 | Asano et al. | |
| 2008/0224965 | A1* | 9/2008 | Kim | 345/76 |
| 2009/0051628 | A1* | 2/2009 | Kwon | 345/77 |
| 2010/0007645 | A1* | 1/2010 | Ono | 345/211 |
| 2010/0053141 | A1* | 3/2010 | Ishiguro et al. | 345/211 |
| 2011/0115764 | A1* | 5/2011 | Chung | 345/205 |
| 2011/0279433 | A1* | 11/2011 | Ryu | 345/211 |
| 2012/0019498 | A1* | 1/2012 | Jeong | 345/211 |
| 2012/0038606 | A1* | 2/2012 | Kang et al. | 345/211 |
| 2012/0200611 | A1* | 8/2012 | Matsui et al. | 345/690 |

OTHER PUBLICATIONS

First Notification of Office Action dated Jul. 10, 2014 from the State Intellectual Property Office of China in counterpart Chines application No. 201210427366.8.

* cited by examiner

FIG. 3

| period | Vn1 | Vn2 | Vn3 |
|---|---|---|---|
| t1 | REF | VDD | VDD |
| t2 | REF | REF-Vth | REF-Vth |
| t3 | DATA | REF-Vth | REF-Vth -C'(REF-DATA) |
| t4 | DATA-[REF-Vth -C'(REF-DATA)-VDD] | VDD | VDD |

ORGANIC LIGHT EMITTING DIODE DISPLAY DEVICE CAPABLE OF COMPENSATING A THRESHOLD VOLTAGE OF A DRIVING TFT

CROSS-REFERENCE TO RELATED APPLICATION

This application claims priority under 35 U.S.C. §119(a) of Korean Patent Application No. 10-2011-0115577, filed on Nov. 8, 2011, which is incorporated by reference in its entirety.

BACKGROUND

1. Technical Field

The following description relates to an organic light emitting diode display device which compensates a threshold voltage of a driving TFT.

2. Discussion of the Related Art

There has been an increasing demand for a display device for displaying an image together with the growth of an information-oriented society, and various flat panel displays such as liquid crystal displays (LCDs), plasma display panels (PDPs), and organic light emitting diodes (OLEDs) have been widely used in recent years. Among the flat panel displays, organic light emitting diode display devices are driven at a low voltage, are thin, have a wide viewing angle and a quick response speed. Among the organic light emitting diode display devices, active matrix type organic light emitting diode display devices have been widely used since they have a plurality of pixels disposed in a matrix form to display an image.

A display panel of the active matrix type organic light emitting diode display device comprises a plurality of pixels arranged in matrix. Each pixel includes a scan TFT (thin film transistor) supplying data voltage from data line in response to scan signal from the scan line and a driving TFT controlling the amount of current supplied to an organic light emitting diode in response to the data voltage supplied to a gate electrode. At this point, the current Ids between a drain electrode and a source electrode of the driving TFT supplied to the organic light emitting diode can be represented by Equation 1:

$$I_{ds}=k'\cdot(V_{gs}-V_{th})^2 \quad \text{[Equation 1]}$$

In equation 1, k' indicates a proportionality factor determined by the structure and physical properties of the driving TFT, Vgs indicates a voltage difference between the gate electrode and source electrode of the driving TFT, and Vth indicates a threshold voltage of the driving TFT.

Meanwhile, due to a threshold voltage shift caused by deterioration of the driving TFT, the threshold voltage Vth of the driving TFT of each of the pixels has a different value. The current Ids between the drain electrode and source electrode of the driving TFT is dependent on the threshold voltage Vth of the driving TFT. Thus, the current Ids between the drain electrode and source electrode of the driving TFT of each pixel is varied even if the same data voltage is supplied to each of the pixels. Accordingly, there arises the problem that the luminance of light emitted from the organic light emitting diode of each of the pixels is varied even if the same data voltage is supplied to each of the pixels. To solve this problem, various types of pixel structures for compensating the threshold voltage of the driving TFT of each of the pixels have been proposed.

However, recently, the organic light emitting diode display device is driven by a high frequency in order to implement a 3D image or improve an image quality. Accuracy of sensing a threshold voltage gets lower because a period for sensing a threshold voltage is shortened due to the high frequency driving.

Also, recently, the organic light emitting diode display device has a big size and a high resolution. Due to a big size and a high resolution, line resistance increases because a length of the line becomes longer. Finally, RC delay can be occurred. The period for sensing a threshold voltage is shortened due to RC delay. Therefore, accuracy of sensing a threshold voltage gets lower.

SUMMARY

One object of the embodiments of this application provides an organic light emitting diode display device which improves accuracy of sensing a threshold voltage of a driving TFT.

To achieve these objects and other advantages and in accordance with the purpose according to one aspect of the invention, an organic light emitting diode display device comprising: a display panel configured to include data lines, first scan lines, second scan lines, control lines, emission lines, and a plurality of pixels disposed in a matrix form, wherein each of the pixels including: a driving TFT configured to have a gate electrode coupled to a first node and a source electrode coupled to a second node; an organic light emitting diode configured to have an anode electrode a drain electrode of the driving TFT and a cathode electrode coupled to a first level voltage supply source supplying a first level voltage; a first TFT configured to supply a data voltage of the data line to the first node in response to a first scan signal of the first scan line; a second TFT configured to supply a reference voltage to the first node in response to a second scan signal of the second scan line; a third TFT configured to supply a second level voltage higher than the first level voltage to the second node in response to a emission signal of the emission line; a fourth TFT configured to couple the second node to the third node in response to a control signal of the control line; a first capacitor coupled between the first node and the third node; a second capacitor coupled between the third node and a second voltage supply source supplying the second level voltage.

The features and advantages described in this summary and the following detailed description are not intended to be limiting. Many additional features and advantages will be apparent to one of ordinary skill in the art in view of the drawings, specification and claims.

BRIEF DESCRIPTION OF THE DRAWINGS

FIG. 3 illustrates a table showing voltage variation of nodes;

DETAILED DESCRIPTION

Figure 1:
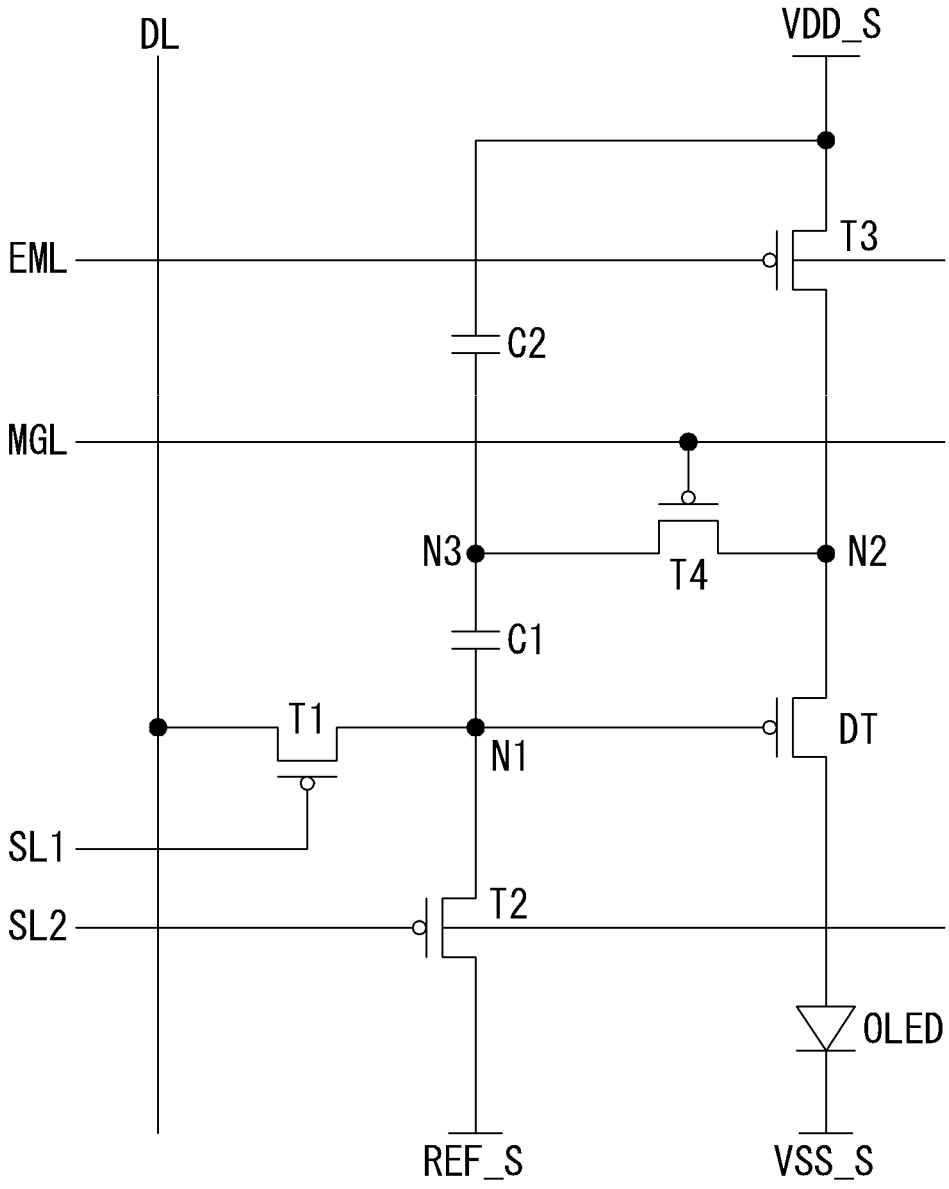
FIG. 1 illustrates an equivalent circuit diagram of a pixel of a display panel according to an exemplary embodiment of the present invention.

The invention will be described more fully hereinafter with reference to the accompanying drawings, in which example embodiments of the inventions are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

FIG. 1 illustrates an equivalent circuit diagram of a pixel of a display panel according to an exemplary embodiment of the present invention. With reference to FIG. 1, the pixel of the display panel includes a driving TFT (Thin Film Transistor) DT, an organic light emitting diode OLED, a control circuit, and capacitors.

The driving TFT DT controls an amount of current Ids between a source electrode and a drain electrode to vary depending on an amount of the voltage applied to a gate electrode. A gate electrode of the driving TFT DT is coupled to the first node N1, a source electrode thereof is coupled to the second node N2, and a drain electrode thereof is coupled to an anode electrode of the organic light emitting diode OLED.

The anode electrode of the organic light emitting diode OLED is coupled to the drain electrode of the driving TFT DT, a cathode electrode of thereof is coupled to a first level voltage supply source. The organic light emitting diode OLED emits light depending on the current Ids between the drain electrode and source electrode of the driving TFT Td.

The control circuit includes a first TFT T1, a second TFT T2, a third TFT T3, and a fourth TFT T4. The first TFT T1 supplies a data voltage DATA of a data line DL to the first node N1 in response to a first scan signal SCAN1 of a first scan line SL1. The data voltage DATA represents an intended intensity level of the OLED. A gate electrode of the first TFT T1 is coupled to the scan line SL1, a source electrode thereof is coupled to the data line DL, and a drain electrode thereof is coupled to the first node N1.

The second TFT T2 initializes a voltage of the first node N1 as a reference voltage from a reference voltage supply source REF_S in response to a second scan signal SCAN2 of a second scan line SL2. A gate electrode of the second TFT T2 is coupled to the second scan line SL2, a source electrode thereof is coupled to the first node N1, and a drain electrode thereof is coupled to the reference voltage supply source REF_S.

The third TFT T3 supplies a second level voltage from a second level voltage supply source to the second node N2 in response to an emission signal EM of an emission line EML. A gate electrode of the third TFT T3 is coupled to the emission line EML, a source electrode thereof is coupled to the second level voltage supply source, and a drain electrode thereof is coupled to the second node N2.

The fourth TFT T4 connects a third node N3 with the second node N2 in response to a control signal MG of a control line MGL. A gate electrode of the fourth TFT T4 is coupled to the control line MGL, a source electrode thereof is coupled to the second node N2, and a drain electrode thereof is coupled to the third node N3.

A first capacitor C1 is coupled between the first node N1 and the third node N3. A second capacitor C2 is coupled between the third node N3 and the second level voltage supply source.

The first node N1 is a contact between the gate electrode of the driving TFT Td, the drain electrode of the first TFT T1, and an electrode of the first capacitor C1. The second node N2 is a contact between the source electrode of the driving TFT Td, the drain electrode of the third TFT T3, and the source electrode of the fourth TFT T4. The third node N3 is a contact between the drain electrode of the fourth TFT T4, the other electrode of the first capacitor C1, and an electrode of the second capacitor C2. The other electrode of the second capacitor is coupled to the second level voltage supply source.

Each of the first to fourth TFTs T1, T2, T3, and T4 and the driving TFT Td of the pixel according to the exemplary embodiment may be composed of a thin film transistor. Semiconductor layers of the first to fourth TFTs T1, T2, T3, and T4 and the driving TFT Td each may be composed of any one of amorphous silicon (a-Si), polycrystalline silicon (poly-Si), and oxide semiconductor. Moreover, the exemplary embodiment has been described focusing on an example in which the first to fourth TFTs T1, T2, T3, and T4 and the driving TFT Td each are implemented as a P-type. In other embodiments, one or more of the TFTs may be implemented with N-type.

The first level voltage supply source may be set to a low potential voltage supply source VSS_S and the second level voltage supply source may be set to a high potential voltage supply source VDD_S. The low potential voltage supply source VSS_S supplies a low potential voltage VSS, and the high potential voltage supply source VDD_S supplies a high potential voltage VDD higher than the low potential voltage VSS. The low supply voltage VSS and the high supply voltage VDD may be set in accordance with characteristics of the driving TFT DT and the organic light emitting diode OLED. The reference voltage REF is a voltage for initializing the first node N1. The reference voltage REF may be set to a voltage lower than a voltage subtracting a threshold voltage of the driving TFT DT from the high potential voltage VDD. Also, the reference voltage REF may be set to a voltage higher than the low potential voltage VSS.

Figure 2:
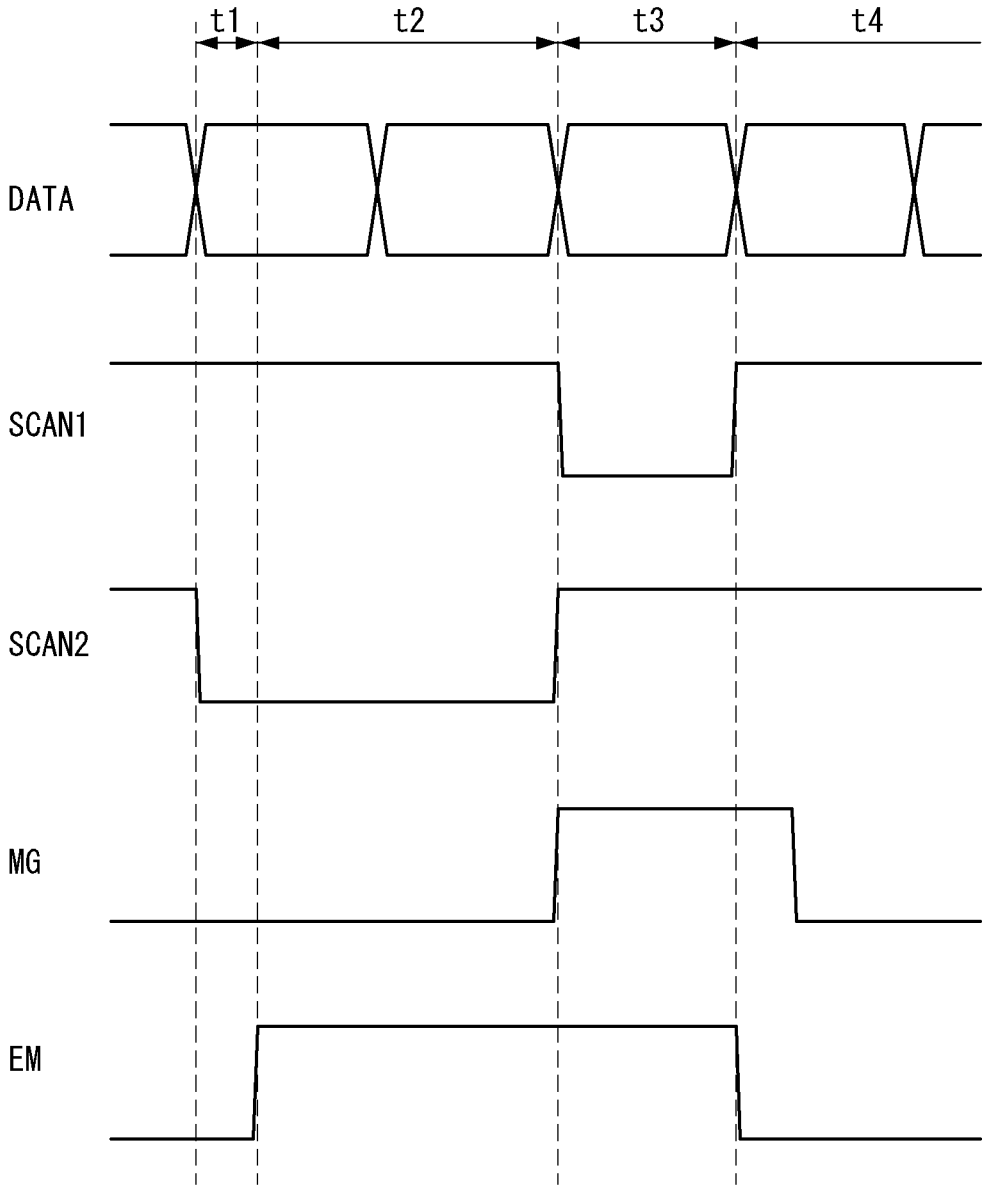
FIG. 2 illustrates waveform diagram showing signals input to the pixel of FIG. 1.

FIG. 2 illustrates waveform diagram showing signals input to the pixel of FIG. 1. The first scan signal SCAN1, the second scan signal SCAN2, the control signal MG, the emission signal EM input to the pixel of the display panel is illustrated in FIG. 2. Also, the data voltage DATA of the data line DL is illustrated in FIG. 2.

With reference to FIG. 2, the first scan signal SCAN1, the second scan signal SCAN2, the control signal MG, and the emission signal EM are signals for controlling the first to fourth TFTs (T1, T2, T3, T4). Each cycle of the first scan signal SCAN1, the second scan signal SCAN2, the control signal MG, and the emission signal EM may be one frame period. One frame period indicates a period in which data voltages are supplied to all pixels of the display panel. Each of the first scan signal SCAN1, the second scan signal SCAN2, the control signal MG, and the emission signal EM swings between a first logic level voltage and a second logic level voltage. In FIG. 2, the first logic level voltage may be a gate high voltage VGH and the second level voltage may be a gate low voltage VGL lower than the gate high voltage.

One frame period includes first to fourth periods t1, t2, t3, t4. The first period t1 is a period for initializing the first node N1, the second node N2, and the third node N3. The second period t2 is a period for sensing the threshold voltage of the driving TFT DT. The third period t3 is a period for supplying the data voltage to the first node N1. The fourth period t4 is a period for emitting the organic light emitting diode OLED.

The first scan signal SCAN1 is generated at the gate high voltage VGH during the first period t1. Also, the second scan signal SCAN2, the control signal MG, and the emission signal EM are generated at the gate low voltage VGL during the first period t1. The first scan signal SCAN1 and the emission signal EM are generated at the gate high voltage VGH during the second period t2. Also, the second scan signal SCAN2 and the control signal MG are generated at the gate low voltage VGL during the second period t2. The second scan signal SCAN2, the control signal MG, and the emission signal EM are generated at the gate high voltage VGH during the third period t3. Also, the first scan signal SCAN1 is generated at the gate low voltage VGL during the third period t3. The first scan signal SCAN1 and the second scan signal SCAN2 are generated at the gate high voltage VGH during the fourth period t4. Also, the control signal MG and the emission signal EM are generated at the gate low voltage VGL during the fourth period t4. Especially, during the fourth period t4, the control signal MG is inverted to the gate low voltage VGL from the gate high voltage VGH after the emission signal EM is inverted to the gate low voltage VGL from the gate high voltage VGH.

A cycle of the data voltage DATA is one horizontal period. Accordingly, the third period t3 in which the data voltage DATA is supplied may be one horizontal period in FIG. 2. One horizontal period indicates a period in which data voltages are supplied to pixels of one horizontal line of the display panel. However, each of the first period t1, the second period t2, the third period t3, and the fourth period t4 may be a few horizontal periods or dozen(s) of horizontal periods in order to improve picture quality of the pixel, and may be predetermined by an experiment.

Figure 4:
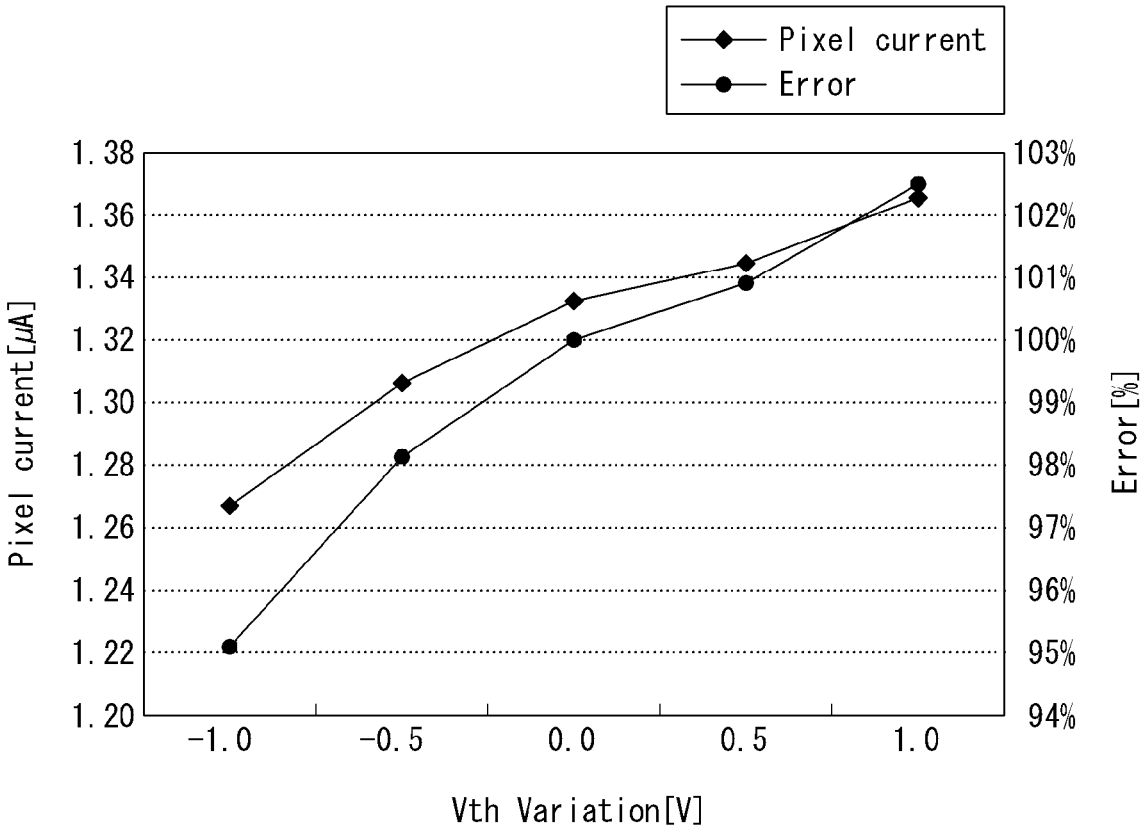
FIG. 4 illustrates a graph showing a compensation error in accordance with threshold voltage variation of a driving TFT.

FIG. 3 illustrates a table showing voltage variation of nodes. Hereinafter, the operation of the pixel according to the exemplary embodiment during the first to fourth periods t1, t2, t3, t4 will be described in detail with reference to FIGS. 1 to 3. In FIG. 4, the first node voltage Vn1 indicates a voltage at the first node N1, the second node voltage Vn2 indicates a voltage at the second node N2, and the third node voltage Vn3 indicates a voltage at the third node N3.

Firstly, during the first period t1, the first scan signal SCAN1 having the gate high voltage VGH is supplied to the pixel through the first scan line SL1. The second scan signal SCAN2 having the gate low voltage VGL is supplied to the pixel through the second scan line SL2. The control signal MG having the gate low voltage VGL is supplied to the pixel through the control line MG. The emission signal EM having the gate low voltage VGL is supplied to the pixel through the emission line EM.

The first TFT T1 is turned off by the first scan signal SCAN1 having the gate high voltage VGH. The second TFT T2 is turned on in response to the second scan signal SCAN2 having the gate low voltage VGL. The first node N1 is coupled to the reference voltage supply source REF_S due to turn-on of the second TFT T2. Thus, a first node voltage Vn1 is discharged to the reference voltage REF. The third TFT T3 is turned on in response to the emission signal EM having the gate low voltage VGL. The second node N2 is coupled to the high potential voltage supply source VDD_S due to turn-on of the third TFT T3. Thus, a second node voltage Vn2 is charged to the high potential voltage VDD. The fourth TFT T4 is turned on in response to the control signal having the gate low voltage VGL. The third node N3 is coupled to the second node N2 due to turn-on of the fourth TFT T4. Thus, a third node voltage Vn3 is charged to the high potential voltage VDD.

Secondly, during the second period t2, the first scan signal SCAN1 having the gate high voltage VGH is supplied to the pixel through the first scan line SL1. The second scan signal SCAN2 having the gate low voltage VGL is supplied to the pixel through the second scan line SL2. The control signal MG having the gate low voltage VGL is supplied to the pixel through the control line MG. The emission signal EM having the gate high voltage VGH is supplied to the pixel through the emission line EM.

The first TFT T1 is turned off by the first scan signal SCAN1 having the gate high voltage VGH. The second TFT T2 is turned on in response to the second scan signal SCAN2 having the gate low voltage VGL. The first node N1 is coupled to the reference voltage supply source REF_S due to turn-on of the second TFT T2. Thus, the first node voltage Vn1 is discharged to the reference voltage REF. The third TFT T3 is turned off by the emission signal EM having the gate high voltage VGH. The second node N2 is floated due to turn-off of the third TFT T3. The fourth TFT T4 is turned on in response to the control signal having the gate low voltage VGL. The third node N3 is coupled to the second node N2 due to turn-on of the fourth TFT T4. Thus, the second node voltage Vn2 and the third node voltage Vn3 are substantially same.

The second node N2 and the third node N3 may sense the threshold voltage Vth of the driving TFT DT because the second node N2 is floated during the second period t2. The difference between the first node voltage Vn1 and the second node voltage Vn2 is greater than the threshold voltage Vth of the driving TFT DT during the second period t2. The difference between the first node voltage Vn1 and the second node voltage Vn2 indicates the difference between the gate electrode of the driving TFT DT and the source electrode thereof. Thus, current flows through the driving TFT DT until the difference between the first node voltage Vn1 and the second node voltage Vn2 reaches the threshold voltage Vth of the driving TFT DT. Accordingly, the second node voltage Vn2 would be lowered to the difference voltage REF-Vth between the reference voltage REF and the threshold voltage Vth of the driving TFT DT during the second period t2. Also, the third node voltage Vn3 would be lowered to the difference voltage REF-Vth between the reference voltage REF and the threshold voltage Vth of the driving TFT DT during the second period t2 because the third node N3 is coupled to the second node N2.

In FIG. 2, the second period t2 may be two horizontal periods. However, the second period t2 may be a few horizontal periods or dozen(s) of horizontal periods, and may be predetermined by an experiment. The embodiments described herein may improve accuracy of sensing the threshold voltage Vth of the driving TFT DT even though an organic light emitting diode display device drives high frequency such as 240 Hz because sensing periods are long enough to sense the threshold voltage Vth of the driving TFT DT.

Thirdly, during the third period t3, the first scan signal SCAN1 having the gate low voltage VGL is supplied to the pixel through the first scan line SL1. The second scan signal SCAN2 having the gate high voltage VGH is supplied to the pixel through the second scan line SL2. The control signal MG having the gate high voltage VGH is supplied to the pixel through the control line MG. The emission signal EM having the gate high voltage VGH is supplied to the pixel through the emission line EM.

The first TFT T1 is turned on in response to the first scan signal SCAN1 having the gate low voltage VGL. The first node N1 is coupled to the data line DL due to turn-on of the first TFT T1. The second TFT T2 is turned off by to the second scan signal SCAN2 having the gate high voltage VGH. Thus, the first node voltage Vn1 is charged to the data voltage DATA. The third TFT T3 is turned off by the emission signal EM having the gate high voltage VGH. The second node N2 is floated due to turn-off of the third TFT T3. The fourth TFT T4 is turned off by the control signal having the gate high voltage VGH. The third node N3 is not coupled to the second node N2 due to turn-off of the fourth TFT T4. Thus, the third node N3 is floated.

The amount of voltage variation of the first node N1 during the third period t3 is applied to the third node N3 through the first capacitor C1. That is, "REF-DATA" which corresponds to the amount of the voltage variation of the first node N1 during the third period t3 is applied to the third node N3 through the first capacitor C1. The third node N3 is located between the first capacitor C1 and the second capacitor C2 that are coupled in series. Hence, the amount of voltage variation in the third node N3 is based on the ratio of C' as shown in Equation 2:

$$C' = \frac{CA1}{CA1 + CA2} \quad \text{[equation 2]}$$

In Equation 2, CA1 indicates the capacitance of the first capacitor C1, and CA2 indicates the capacitance of the second capacitor C2. Consequently, the second node voltage Vn2 is lowered to 'REF-Vth-C' (REF-DATA)' during period t3.

The fourthly, during the fourth period t4, the first scan signal SCAN1 having the gate high voltage VGH is supplied to the pixel through the first scan line SL1. The second scan signal SCAN2 having the gate high voltage VGH is supplied to the pixel through the second scan line SL2. The control signal MG having the gate low voltage VGL is supplied to the pixel through the control line MG. The emission signal EM having the gate low voltage VGL is supplied to the pixel through the emission line EM. Especially, during the fourth period t4, the control signal MG is inverted to the gate low voltage VGL from the gate high voltage VGH after the emission signal EM is inverted to the gate low voltage VGL from the gate high voltage VGH.

The first TFT T1 is turned off by the first scan signal SCAN1 having the gate high voltage VGH. The second TFT T2 is turned off by to the second scan signal SCAN2 having the gate high voltage VGH. Thus, the first node is floated due to turn-off of the first TFT T1 and turn-off of the second TFT T2. The third TFT T3 is turned on in response to the emission signal EM having the gate high voltage VGH. The second node N2 is coupled to the high potential voltage supply source VDD_S due to turn-on off the third TFT T3. Thus, the second node voltage Vn2 is charged to high potential voltage VDD. The fourth TFT T4 is turned on in response to the control signal having the gate low voltage VGL. The third node N3 is coupled to the second node N2 due to turn-on of the fourth TFT T4. Thus, a third node voltage Vn3 is charged to the high potential voltage VDD.

The amount of voltage variation of the third node N3 during the fourth period t4 is applied to the first node N1 through the first capacitor C1. That is, "REF-Vth-C' (REF-DATA)-VDD" which corresponds to the amount of the voltage variation of the third node N3 during the fourth period t4 is applied to the first node N1 through the first capacitor C1. Therefore, the first node voltage Vn1 is changed to "DATA-{REF-Vth-C' (REF-DATA)-VDD}".

The current Ids between the drain and source of the driving TFT Td is supplied to the organic light emitting diode OLED. The current Ids between the drain and source of the driving TFT Td is represented by Equation 3:

$$I_{ds}=k'\cdot(V_{gs}-V_{th})^2 \quad \text{[Equation 3]}$$

In equation 3, k' indicates a proportionality factor determined by the structure and physical properties of the driving TFT DT, which is determined by the mobility, channel width, channel length, etc. of the driving TFT Td. Vgs indicates the voltage difference between the gate electrode and source electrode of the driving TFT Td. Vth indicates the threshold voltage of the driving TFT Td. "Vgs−Vth" during the fourth period t4 is as shown in Equation 4:

$$\text{Vgs}-\text{Vth}=[\text{DATA}-\{\text{REF}-\text{Vth}-C'(\text{REF}-\text{DATA})-\text{VDD}\}-\text{VDD}]-\text{Vth} \quad \text{[Equation 4]}$$

In Equation 4, the current Ids between the drain and source of the driving TFT Td is derived as shown in Equation 5:

$$I_{ds}=k'[(C'-1)\cdot(\text{REF-DATA})]^2 \quad \text{[Equation 5]}$$

As shown in equation 5, the current Ids between the drain and source of the driving TFT Td supplied to the organic light emitting diode OLED during the fourth period t4 is dependent only on proportionality factor k', the capacitance of the first capacitor C1, the capacitance of the second capacitor C2, the data voltage DATA, and the reference voltage REF. The current Ids between the drain and source of the driving TFT Td is not dependent on the threshold voltage Vth of the driving TFT Td. Therefore, the threshold voltage Vth of the driving TFT Td is compensated for.

Additionally, the high potential voltage supply source VDD_S supplies the high potential voltage VDD to all pixels of the display panel. However, the high potential voltage VDD is dropped because the driving TFT DT and the organic light emitting diode display OLED of each pixel existing according to a current path from the high potential voltage supply source VDD_S to the low potential voltage supply source VSS_S function as resistances. The current Ids between the drain and source of the driving TFT Td is not dependent on the high potential voltage VDD because the high potential voltage VDD applied at the gate electrode of the driving TFT DT and the high potential voltage VDD applied at the source electrode thereof during the fourth period t4 is a voltage dropped. Therefore, any drop in the high potential voltage VDD is also compensated for.

FIG. 4 illustrates a graph showing a compensation error in accordance with threshold voltage variation of a driving TFT. With reference to FIG. 4, the threshold variation Vth Variation [V] of the driving TFT DT is shown in a horizontal axis, the current Pixel current[μA] between the drain and source of the driving TFT Td is shown in a left-vertical axis, and an error Error(%) of the current between the drain and source of the driving TFT Td is shown in right-vertical axis.

The threshold voltage shift of the driving TFT DT of each pixel may be caused by deterioration of the driving TFT DT. Thus, organic light emitting diode display device compensate the threshold voltage Vth of the driving TFT DT by sensing the threshold voltage Vth thereof. However, the current Ids between the drain and source of the driving TFT Td may have an error when accuracy of sensing the threshold voltage Vth of the driving TFT TD is low.

As shown in FIG. 4, when the threshold voltage variation Vth Variation[V] is −1.0V to 1.0V, the current Ids between the drain and source of the driving TFT Td is approximately 1.26 μA to 1.36 μA, and the error Error(%) of the current Ids between the drain and source of the driving TFT Td is approximately −5% to +2.5%. That is, the embodiments described herein may decrease the error Error(%) of the current Ids between the drain and source of the driving TFT Td into −5% to +2.5%.

Figure 5:
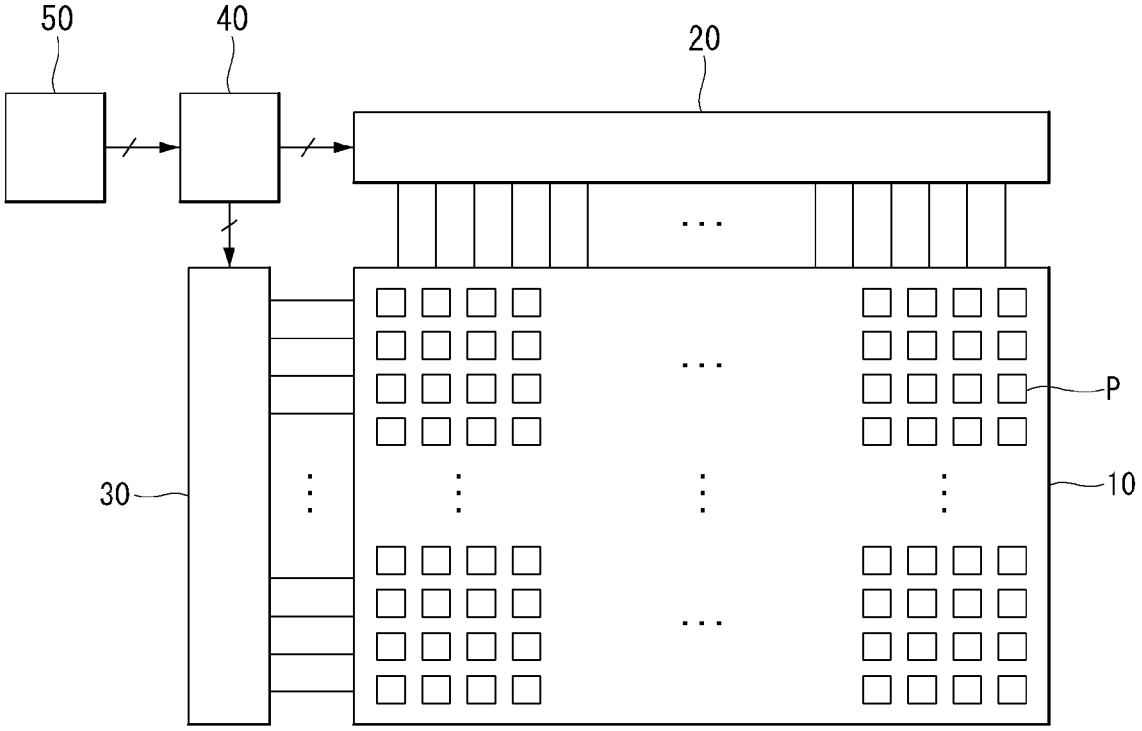
FIG. 5 illustrates a block diagram schematically showing an organic light emitting diode display device according to an exemplary embodiment of the present invention.

FIG. 5 illustrates a block diagram schematically showing an organic light emitting diode display device according to an exemplary embodiment of the present invention. Referring to FIG. 5, the organic light emitting diode display device according to the exemplary embodiment comprises a display panel 10, a data driving circuit 20, a gate driving circuit 30, a timing controller 40, and a host system 50.

The display panel 10 has data lines DL and first scan lines SL1 crossing each other. Also, the display panel 10 has second scan lines SL2, control lines MGL, and emission lines EML in parallel with the first scan lines SL1. The display panel 10 comprises a pixel array having pixels P disposed in a matrix form in. A detailed description of each pixel P of the display panel 10 was previously described by reference to FIGS. 1-4.

The data driving circuit 20 comprises a plurality of source drive ICs. The source drive ICs receive digital video data from the timing controller 40. The source drive ICs convert the digital video data into gamma correction voltages to generate data voltages, in response to source timing control signals from the timing controller 40. And then, the source drive ICs supply the data voltages to the data lines DL of the display panel 10 in synchronization with the first scan signals from the gate driving circuit 30.

The gate driving circuit 30 comprises a first scan signal output unit (not shown), a second scan signal output unit (not shown), a control signal output unit (not shown), and an emission signal output unit (not shown). The first scan signal output unit supplies sequentially the first scan signals SCAN1 to the first scan lines SL1 of the display panel 10. The second scan signal output unit supplies sequentially the second scan signals SCAN2 to the second scan lines SL2 of the display panel 10. The control signal output unit supplies sequentially the control signals MG to the control lines MGL of the display panel 10. The emission signal output unit supplies sequentially the emission signals EM to the emission lines EML of the display panel 10. A detailed description of the first scan signal SCAN1, the second scan signal SCAN2, the control signal MG, and the emission signal EM was previously described by reference to FIGS. 1-4.

The timing controller 40 receives the digital video data from the host system 50 via an interface such as an LVDS (low voltage differential signaling) interface, a TMDS (transition minimized differential signaling) interface or the like. The timing controller 40 transmits the digital video data input from the host system 50 to the data driving circuit 20.

The timing controller 40 receives timing signals such as a vertical synchronization signal, a horizontal synchronization signal, a data enable signal, a main clock, and so forth from the host system 50. The timing controller 40 generates timing control signals for controlling operation timings of the data driving circuit 20 and the gate driving circuit 30 based on the timing signals from the host system 50. The timing control signals comprise gate timing control signals for controlling operation timings of the gate driving circuit 30, and data timing signals for controlling operation timings of the data driving circuit 30.

The embodiments described herein may improve accuracy of sensing a threshold voltage Vth of a driving TFT DT even though an organic light emitting diode display device drives high frequency such as 240 Hz because sensing periods are long enough to sense the threshold voltage Vth of the driving TFT DT. Also, the embodiments described herein may compensate a drop of a high potential voltage VDD due to compensating the current Ids between a drain electrode and a source electrode of the driving TFT DT by using the high potential voltage VDD dropped.

Although the embodiments of this application have been described with reference to a number of illustrative embodiments thereof, it should be understood that numerous other modifications and embodiments of this application can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display device comprising:

a display panel configured to include data lines, first scan lines, second scan lines, control lines, emission lines, and a plurality of pixels disposed in a matrix form, each of the pixels including:

a driving TFT configured to have a gate electrode coupled to a first node and a source electrode coupled to a second node;

an organic light emitting diode configured to have an anode electrode a drain electrode of the driving TFT and a cathode electrode coupled to a first level voltage supply source supplying a first level voltage;

a first TFT configured to supply a data voltage of the data line to the first node in response to a first scan signal of the first scan line;

a second TFT configured to supply a reference voltage to the first node in response to a second scan signal of the second scan line;

a third TFT configured to supply a second level voltage higher than the first level voltage to the second node in response to an emission signal of the emission line;

a fourth TFT configured to couple the second node to a third node in response to a control signal of the control line;

a first capacitor coupled between the first node and the third node; and a second capacitor coupled between the third node and a second voltage supply source supplying the second level voltage, wherein the control signal is inverted to a second logic level voltage from a first logic level voltage after the emission signal is inverted to the second logic level voltage from the first logic level voltage during a fourth period for emitting the organic light emitting diode.

2. The organic light emitting diode display device of claim 1, wherein during a first period in which the reference voltage is supplied to the first node and the second level voltage is supplied to the second and third node for initialization, the first scan signal is generated as the first logic level voltage, and the second scan signal, the control signal, and the emission signal are generated as the second logic level voltage.

3. The organic light emitting diode display device of claim 2, wherein during a second period for sensing a threshold voltage of the driving TFT, the first scan signal and the emission signal are generated as the first logic level voltage, and the second scan signal and the control signal are generated as the second logic level voltage.

4. The organic light emitting diode display device of claim 3, wherein during a third period for supplying the data voltage to the pixel, the second scan signal, the control signal, and the emission signal are generated in the first logic level voltage, and the first scan signal is generated in the second logic level voltage.

5. The organic light emitting diode display device of claim 4, wherein during the fourth period for emitting the organic light emitting diode, the first scan signal and the second scan signal are generated as the first logic level voltage.

6. The organic light emitting diode display device of claim 5, wherein the first logic level voltage is higher than the second logic level voltage.

7. The organic light emitting diode display device of claim 6, wherein each of the first to the fourth TFTs is a P-type transistor.

8. The organic light emitting diode display device of claim 1, wherein a gate electrode of the first TFT is coupled to the first scan line, a source electrode thereof is coupled to the data line, and a drain electrode thereof is coupled to the first node, a gate electrode of the second TFT is coupled to the second scan line, a source electrode thereof is coupled to the first node, and a drain electrode thereof is coupled to a reference voltage supply source supplying the reference voltage, a gate electrode of the third TFT is coupled to the emission line, a source electrode thereof is coupled to the second level voltage supply source, and a drain electrode thereof is coupled to the second node, a gate electrode of the fourth TFT is coupled to the control line, a source electrode thereof is coupled to the second node, and a drain electrode thereof is coupled to the third node.

9. The organic light emitting diode display device of claim 1, wherein the reference voltage is lower than a difference voltage between the second level voltage and a threshold voltage of the driving TFT, and is greater than the first logic level voltage.

10. The organic light emitting diode display device of claim 1, wherein the first level voltage is a low potential voltage and the second level voltage is a high potential voltage.

* * * * *